US006279472B1

(12) United States Patent
Kishine et al.

(10) Patent No.: US 6,279,472 B1
(45) Date of Patent: Aug. 28, 2001

(54) WEB CURLING PREVENTION DEVICE FOR A ROTARY PRINTING PRESS OR THE LIKE

(75) Inventors: Toshiaki Kishine; Yuichi Yamazaki, both of Chiba; Kenichiro Wada, Tokyo, all of (JP)

(73) Assignee: Miyakoshi Printing Machinery, Co., Ltd., Chiba (JP)

( * ) Notice: Subject to any disclaimer, the term of this patent is extended or adjusted under 35 U.S.C. 154(b) by 0 days.

(21) Appl. No.: 09/556,840

(22) Filed: Apr. 21, 2000

(30) Foreign Application Priority Data

Aug. 31, 1999 (JP) ..... P11-246228

(51) Int. Cl.[7] ..... B41F 13/54

(52) U.S. Cl. ..... 101/228; 101/227; 101/DIG. 42; 226/195

(58) Field of Search ..... 101/216, 219, 101/226, 227, 228, DIG. 42; 226/11, 34, 35, 45, 195

(56) References Cited

U.S. PATENT DOCUMENTS 3,667,664 * 6/1972 Schroeder ..... 226/30
3,912,145 * 10/1975 Meihofer ..... 226/44
4,129,238 * 12/1978 Herd ..... 226/29
5,003,889 * 4/1991 Glunz et al. ..... 101/228
5,024,156 * 6/1991 Hank et al. ..... 101/216

* cited by examiner

*Primary Examiner*—Ren Yan
(74) *Attorney, Agent, or Firm*—Wenderoth, Lind & Ponack, L.L.P.

(57) ABSTRACT

A rotary printing press has a postprinting processing station where the printed web of paper, stretched out between two pairs of nip rollers, is slit longitudinally into a pair of web halves and where the web halves are subsequently superposed one upon the other. This station includes a tension roller for imparting tension to the web being slit, and a set of turnbars for causing a change in the traveling direction of one of the web halves before being placed in register with the other. The tension roller and one of the turnbars are both automatically driven to their working positions with the start of machine operation and retracted when the machine is set out of operation.

8 Claims, 7 Drawing Sheets

WEB CURLING PREVENTION DEVICE FOR A ROTARY PRINTING PRESS OR THE LIKE

BACKGROUND OF THE INVENTION

This invention relates generally to an apparatus handling a continuous web of paper or like material such as, typically, a web-fed rotary printing press. More specifically, the invention deals with how to preclude, in a rotary printing press or the like, the curling of the web from being held under tension against such relatively small-diameter, web-tensioning members as tension rollers and turnbars for an extended period of time when the machine is out of operation.

As a typical application of the instant invention, let us consider the postprinting station in a web-fed rotary printing press where the printed web is slit longitudinally into a pair of halves and where the web halves are subsequently placed one upon the other. The web is held taut between pairs of nip rollers as it travels along the predefined path through the postprinting station. Conventionally, the web has been held tightly against guide rollers, tension rollers, and turnbars regardless of whether the press is in or out of operation. Left tightened against such members, particularly those of relatively small diameters, for an extended period of time, the web easily develop semipermanent curls.

The curling web has caused some serious inconveniences in subsequent processing thereof. For instance, when the superposed web halves are cut transversely into individual sheets, they have tended to warp while or after being cut, jamming the cutter in the worst case. Furthermore the warping sheets have often impeded such additional postprinting operations as folding, pressing, and delivery, again possibly resulting in jamming or in the wrinkling of the products.

A so-called "decurler" has been known and used for removing the curl from a continuous web or strip of paper that has been kept in roll form, by running the web. The web that has curled from being kept in roll form does so in one direction only, but the web curls indefinitely in both directions in a rotary printing press. Some of such web curls might therefore grow even worse should the web be rubbed only in one way.

There are additional objections to curl removal by rubbing. The forcible rubbing of paper can damage its surface and create large volumes of fibrous dust. Such dust not only deteriorates the quality of the printings but pollutes the working atmosphere.

SUMMARY OF THE INVENTION

It is therefore an object of this invention to preclude the development of curls in a web of paper or the like, no matter how long it has been kept threaded through a rotary printing press in particular, rather than to remove the curls after they have been created.

Another object of the invention is to compactly incorporate the means for curl preclusion into a rotary printing press or the like without in any way interfering with the intrinsic operations of the machine.

A further object of the invention is to automate the curl precluding means in relation to the beginning and end of the operation of the machine, demanding no additional labor on the part of the machine operator or supervisor for the functioning of the curl precluding means.

Briefly, the present invention concerns a web-handling machine such as a web-fed rotary printing press wherein a continuous web of paper or like material is guided to travel along a predefined path. More specifically, in such a machine, the invention pertains to the combination of a tension member such as a tension roller or a turnbar, and drive means for moving the tension member between a working position, in which the tension member is disposed contiguous to the predefined path of the web for holding the same under tension, as when the machine is in operation, and a retracted position in which the tension member is held away from the predefined path of the web for relieving the same of tension, as when the machine is out of operation.

Thus, when the machine is out of operation, the web is slackened by the retraction of the tension member and so does not curl from being held still and under tension against the tension member for an extended period of time. Since the web does not develop any semipermanent curls according to the invention, no rubbing of the web is necessary as has been taught heretofore. The means for retraction of the tension member, which may take any of several different forms to be herein disclosed, can be compactly built into a web-fed rotary printing press of standard construction.

Preferably, the tension member is retracted as above while the web is held nipped by rollers on the upstream and downstream sides, respectively, of the tension member. There will consequently be no longitudinal displacement of the web relative to the tension member when the latter is subsequently driven back from the retracted to the working position.

According to a further feature of the invention, the travel of the tension member is automated in relation to the operation and nonoperation of the machine. It is automatically driven to the working position when the machine is set into operation, and retracted when the machine is set out of operation. No additional task is thus imposed on the machine operator in order to prevent the curling of the web.

The above and other objects, features and advantages of this invention and the manner of achieving them will become more apparent, and the invention itself will best be understood, from a study of the following description and attached claims, with reference had to the accompanying drawings showing the preferred embodiments of the invention.

DESCRIPTION OF THE PREFERRED EMBODIMENTS

Figure 1:
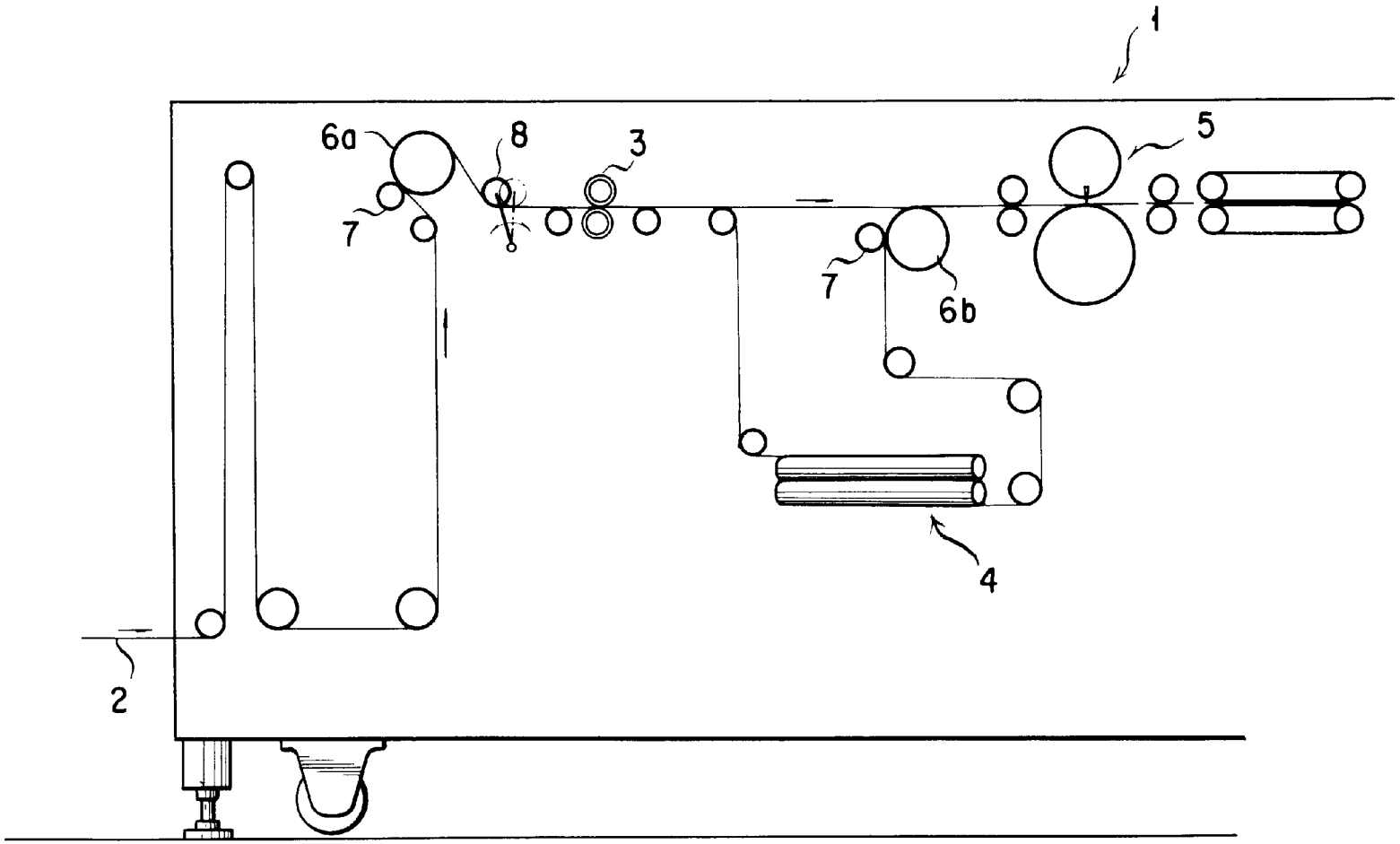
FIG. 1 is a schematic diagram of a postprinting processing station of a web-fed rotary printing press to which the present invention finds application.

The present invention is believed to be best applicable to a web-fed rotary printing press, particularly to its postprinting station where the printed web is cut longitudinally into a pair of halves, where the web halves are superposed one upon the other, and the superposed web halves are cut transversely into individual sheets. Such a postprinting station is illustrated in FIG. 1 and therein generally designated 1. Fed from a printing station, not shown, a continuous web 2 of paper travels along a predefined path through the postprinting station 1.

Figure 2:
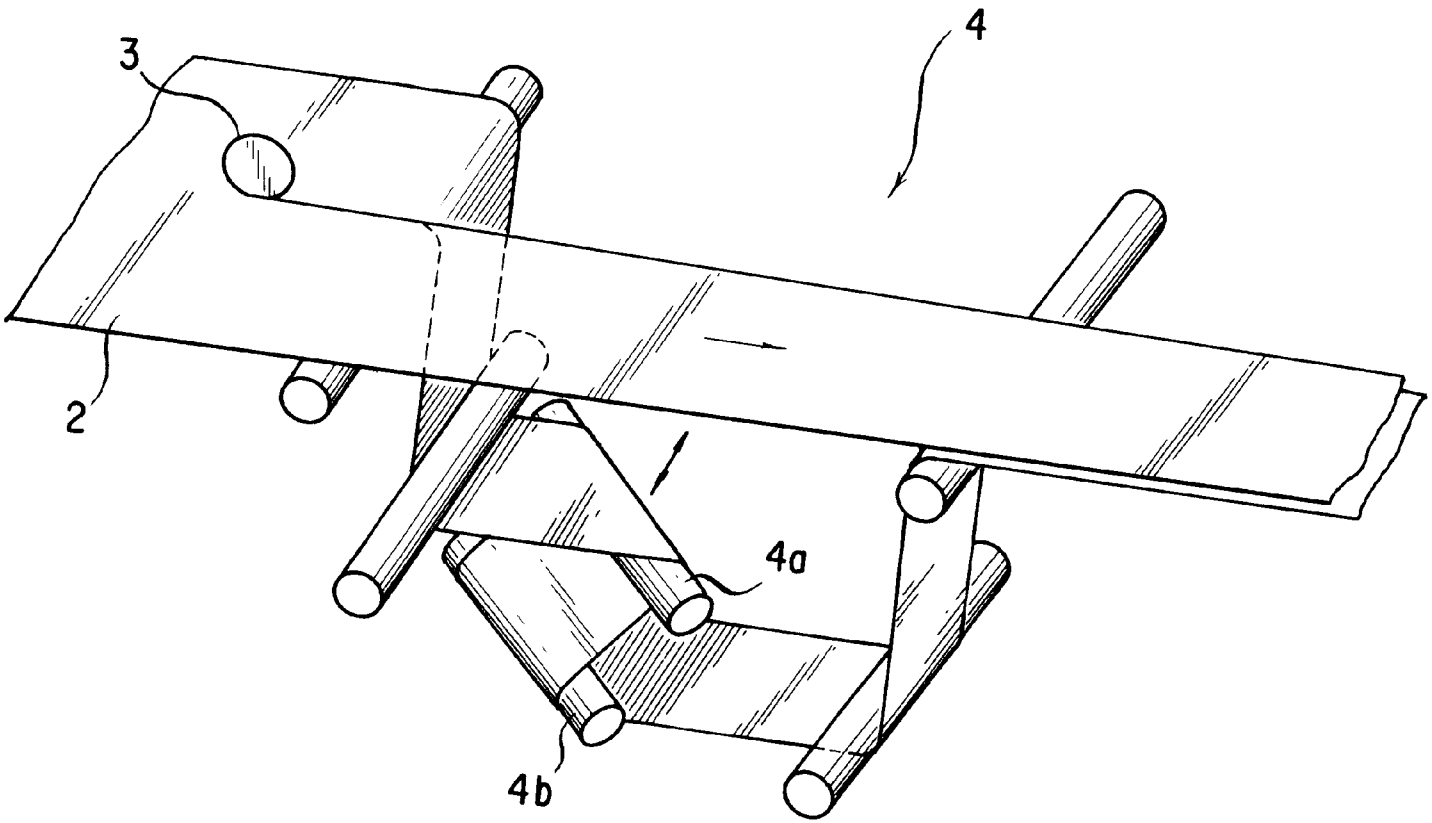
FIG. 2 is an enlarged, fragmentary perspective view of the FIG. 1 apparatus, showing in particular the turnbar system whereby one half of the web is placed under the other half.

As better illustrated in FIG. 2, the web 2 is first cut in the middle by a rotary center slitter 3. One of the pair of web halves thus created is then guided by a turnbar system 4, including two turnbars 4*a* and 4*b*, arranged one under. The other and next to each other. Then the thus-superposed web halves are cut by a transverse cutter 5, FIG. 1, into individual sheets of a desired top-to-bottom dimension.

For the accomplishment of the above specified postprinting processes in this process station 1, the web 2 is normally held taut by and between tension rollers 6*a* and 6*b* of relatively large diameters. A nip roller 7 makes rolling contact with each of the tension roller 6*a* and 6*b* via the web which travels through a relatively large angle around these tension rollers, in order to avert the risk of web slippage over the tension rollers.

Of the various web-tensioning members existing in this process station 1, those particularly liable to create curls in the web 2, if the web is to be left held tightly against them when the press is out of operation, are a tension roller 8 lying just downstream of the tension roller 6*a*, and the turnbar 4*a* of the turnbar system 4. It will be seen that the tension roller 8 and the turnbar 4*a* are much smaller in diameter than the tension rollers 6*a* and 6*b*, and the web makes relatively sharp turns around these members. Therefore, according to the novel concepts of this invention, the tension roller 8 and the turnbar 4*a* are both made retractable from the predefined path of the web when the press is out of operation.

Figure 3:
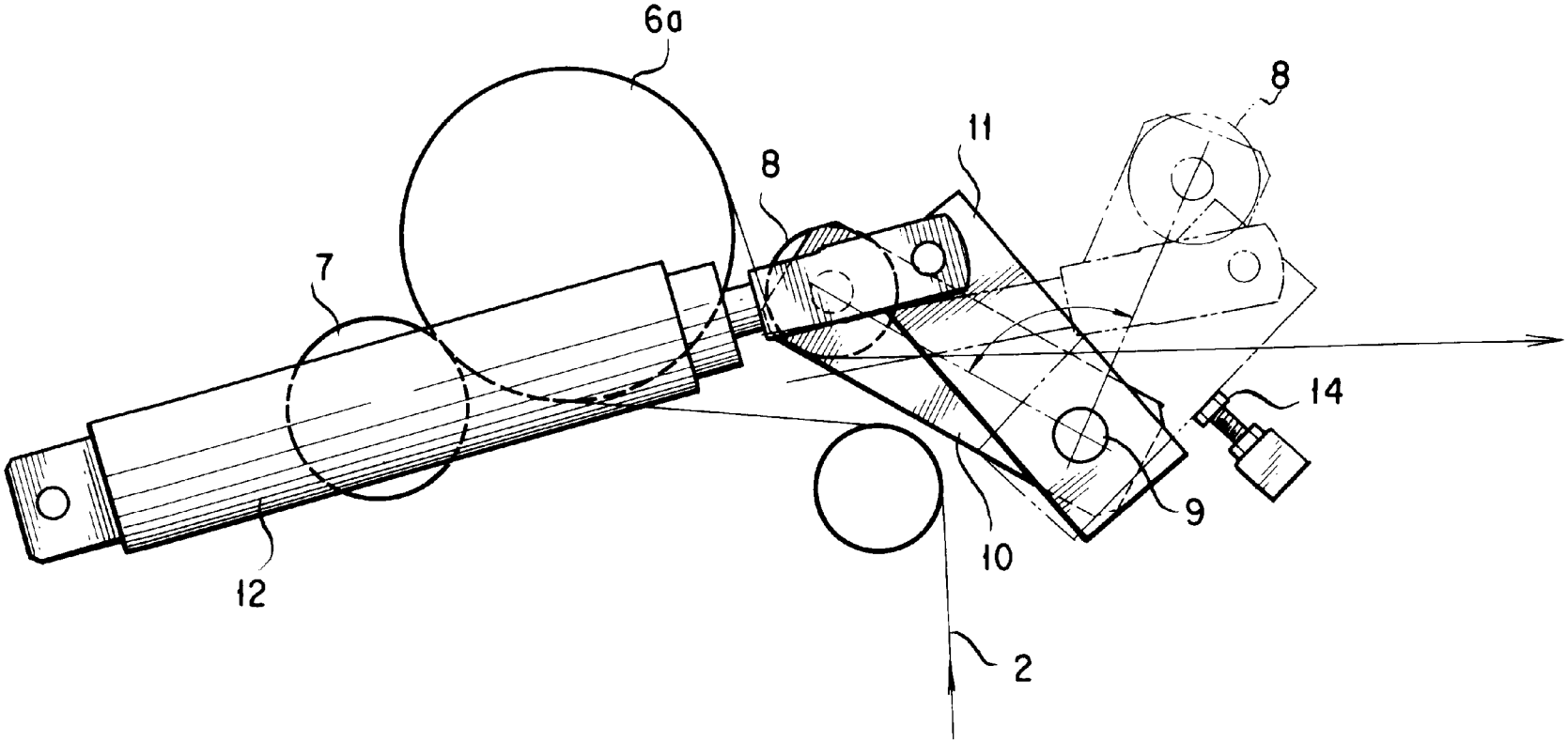
FIG. 3 is an enlarged, fragmentary elevational view of the FIG. 1 apparatus, showing in particular the tension roller together with the drive means for moving the same between working and retracted positions.
Figure 4:
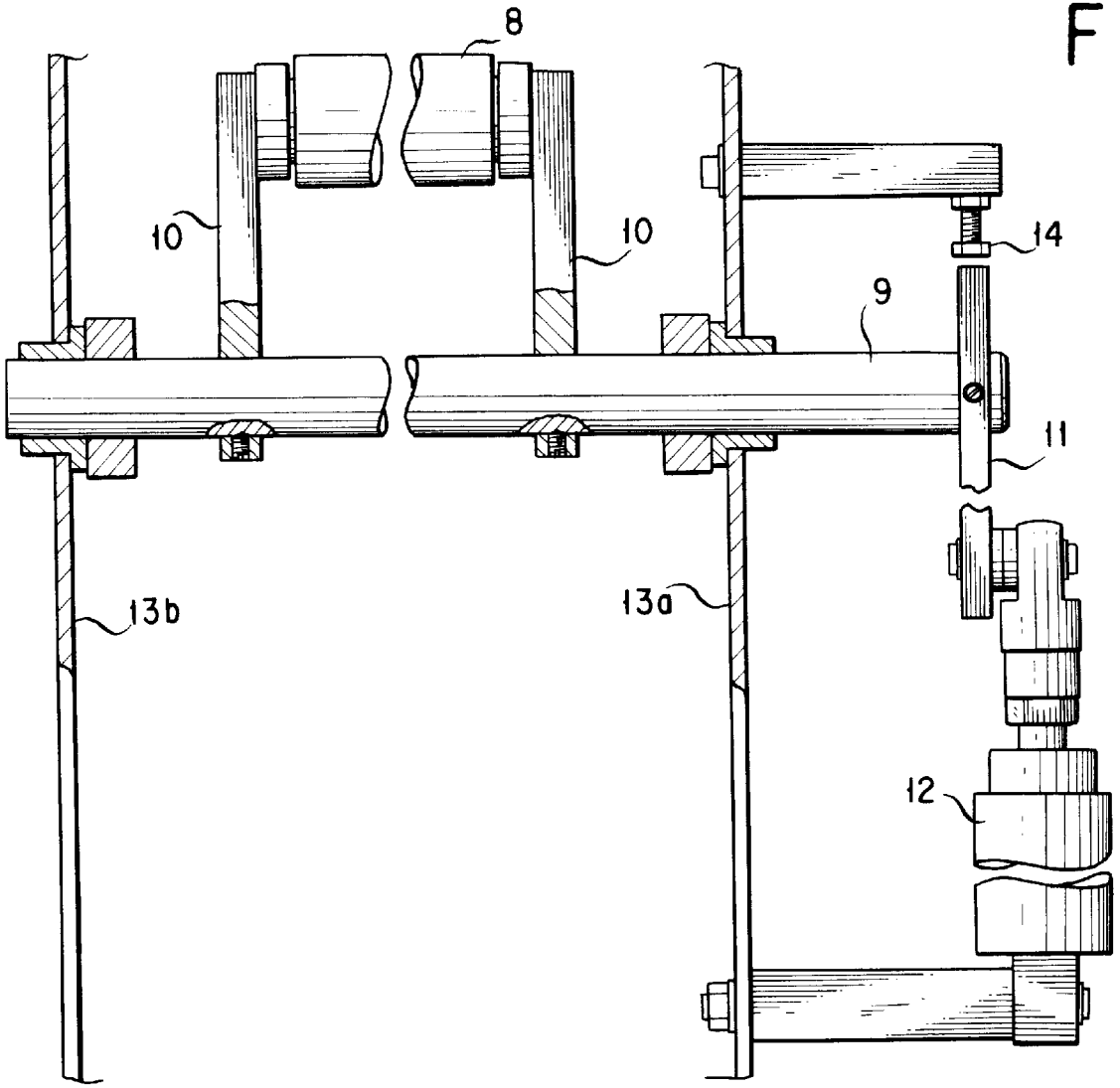
FIG. 4 is a horizontal section through the showing of FIG. 3, with parts shown broken away for illustrative convenience.

A study of both FIGS. 3 and 4 will reveal how the tension roller 8 is made retractable. At 9 in these figures is seen a crankshaft supported by and between a pair of confronting framing walls 13*a* and 13*b* for rotation about an axis parallel to the axis of rotation of the tension roller 8. A pair of crank webs 10 are proximally coupled fast to the crankshaft 9 for joint angular displacement therewith and distally rotatably carry the tension roller 8. A linear actuator such as a fluid actuated cylinder, preferably a double-acting, single-ended-rod air cylinder 12, is operatively coupled to the crankshaft 9 via a crank arm 11. An adjustable stopper is provided at 14 for limiting the extension of the cylinder 12 by engaging the crank arm 11.

Thus, with the extension and contraction of the cylinder 12, the tension roller 8 travels between a solid-line working position and a phantom retracted position of FIG. 3. In the working position the tension roller 8 lies contiguous to, and extends across, the predefined path of the web 2, holding the same closely wrapped around the upstream large-diameter tension roller 6a and imparting tension to the web 2 as the same is cut longitudinally by the slitter 3 positioned immediately downstream. When retracted away from the web path, on the other hand, the tension roller 8 relieves the web 2 of tension between tension roller 6*a* and slitter 3.

Referring again to FIG. 2, the turnbar 4*a* of the turnbar system 4 extends at an angle to the transverse direction of one of the web halves 2 in order to cause an angular change of, say, 90 degrees in its traveling direction. Extending parallel to the turnbar 4*a* and displaced downwardly therefrom, the other turnbar 4*b* causes another angular change of 90 degrees in the traveling direction of the web half in question, with the result that the web half is directed into underlying relationship to, and vertical registry with, the other web half. Additional guide rods of the turnbar system 4 bring the two web halves in close superposition with each other.

A closer study of FIG. 2 will reveal that the web half would be particularly liable to develop semipermanent curls around the two turnbars 4a and 4b should it be left tight against them when the machine is out of operation. Therefore, as indicated by the double-headed arrow in this figure, the upper turnbar 4a is made retractable as aforesaid in the transverse direction of the web half before it is altered in traveling direction by that turnbar.

Figure 5:
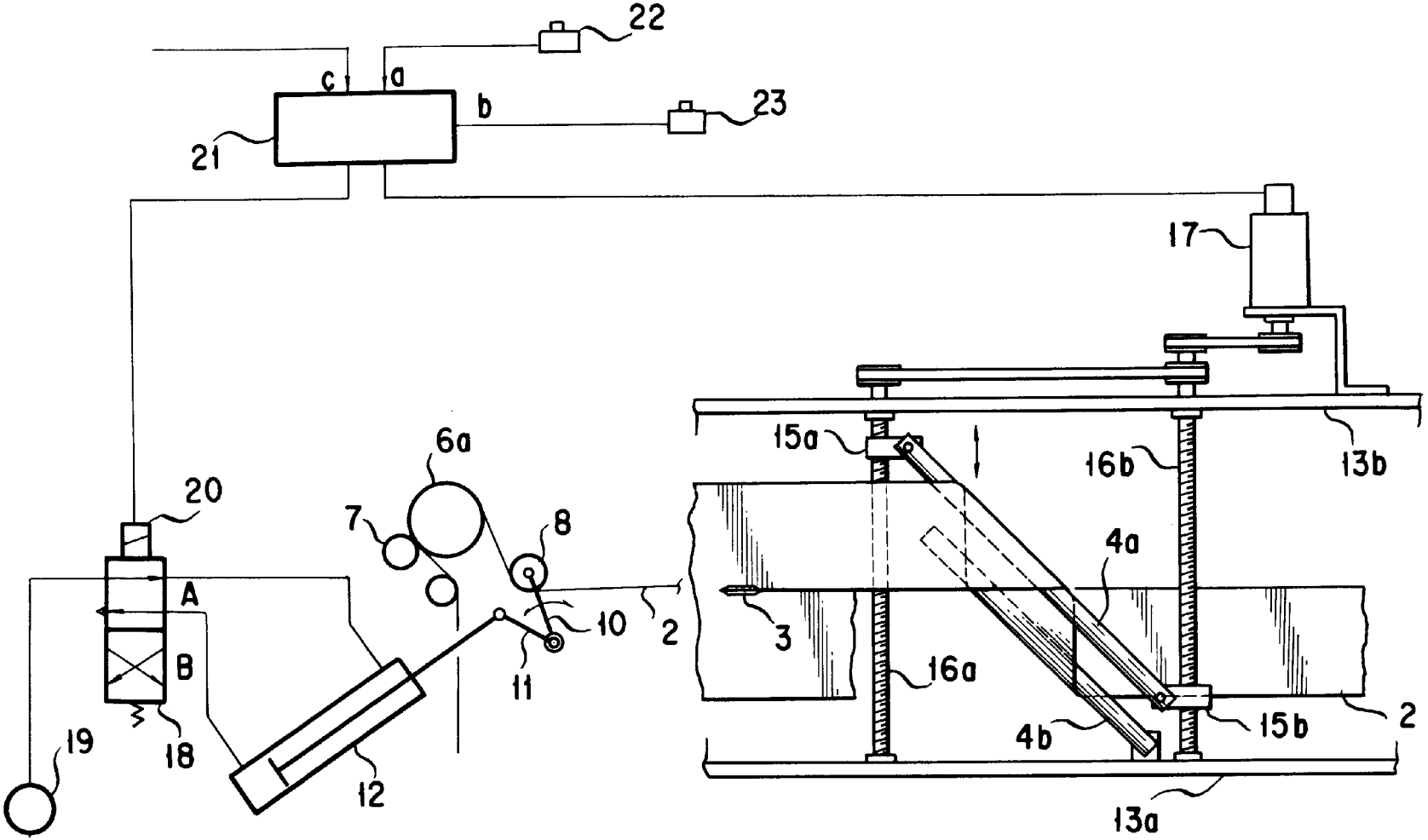
FIG. 5 shows in a top plan view the drive means for moving a turnbar of the FIG. 2 turnbar system between working and retracted positions, also showing diagrammatically the electric control system for both the turnbar and the FIGS. 3 and 4 tension roller.

FIG. 5 shows the means for such turnbar retraction. Included are a pair of lead screws 16*a* and 16*b* rotatably supported by and between the pair of framing walls 13*a* and 13*b*. The lead screws 16*a* and 16*b* extend transversely of the unaltered web path and in parallel spaced relationship to each other. A pair of nuts 15*a* and 15*b* are fitted one over each lead screw and coupled to the opposite ends of the turnbar 4*a*. An actuator such as, desirably, a reversible servomotor 17 complete with an encoder is mounted fast to the framing wall 13*b* and coupled to both lead screws 16*a* and 16*b* via a drive linkage such as that comprised of timing belts and pulleys.

Thus, with the bidirectional rotation of the servomotor 17, the turnbar 4*a* will travel linearly with the pair of nuts 15*a* and 15*b* between a working and a retracted position. The turnbar 4*a* when in the working position will be held against one of the web halves, tensioning the same between the tension rollers 6*a* and 6*b*, FIG. 1. Upon retraction of the turnbar 4*a*, on the other hand, the web half in question will be loosened from both turnbars 4*a* and 4*b*. The turnbar 4*b* is shown fragmentarily in FIG. 5, it being understood that this turnbar is immovably bracketed to both framing walls 13*a* and 13*b*.

FIG. 5 also illustrates an automatic control system for the retractable tension roller 8 and retractable turntable 4*a*. A solenoid-actuated directional control valve is provided at 18 for alternately placing the pair of opposite air chambers of the air cylinder 12 with a source 19 of compressed air. The actuating solenoid 20 of this valve 18 is electrically connected to a control 21 in order to be energized and deenergized in response to a signal therefrom. The servomotor 17 is also electrically connected to the controller 21 in order to be set into and out of rotation in either direction under its direction.

The controller 21 has an input a for receiving from a "ready" switch 22 a "ready" signal indicative of the fact that the printing press is about to start running, another input b for receiving an overriding manual control signal from another switch 23, and still another input c for receiving a "go" or "operation" signal indicative of the fact that the machine has actually been set in operation. It is customary in the printing industry that the "ready" switch be actuated for sounding an alarm bell preparatory to the start of operation of the printing press. Then the machine is started running by actuating the "go" switch, not shown.

It is hereby suggested that the tension roller 8 and the turnbar 4*a* be driven to their working positions upon actuation of the "ready" switch 22. The controller 21 may therefore be made to respond to the actuation of the "ready"

switch 22 by actuating the valve 18 so as to place the rod end chamber of the air cylinder 12 in communication with the compressed air source 19 and, at the same time, by causing rotation of the servomotor 17 in a prescribed forward direction. The resulting contraction of the air cylinder 12 will cause the tension roller 8 to be pivoted to the solid-line working position of FIG. 3. The turnbar 4*a* will also be driven to its working position of FIG. 5 upon forward rotation of the servomotor 17.

The printing press will actually start running when the unshown "go" switch is subsequently actuated. Thereupon the control 21 will respond to the incoming "go" signal by retaining the tension roller 8 and turnbar 4*a* in their working positions. Being nipped against the tension rollers 6*a* and 6*b*, the web 2 will be tensed therebetween as the tension roller 8 and turnbar 4*a* are driven to their working positions. Thus the web 2 will start running under tension through the postprinting station 1.

Possibly, however, the "go" switch may be left untouched for a prolonged length of time after the actuation of the "ready" switch. It is undesirable that the web be left under tension during such a time. Preferably, therefore, the controller 21 may be made to cause the tension roller 8 and turnbar 4*a* to return to their retracted positions when the machine is not started running for a prescribed length of time, 30 seconds for instance, after the actuation of the "ready" switch.

When the machine is set out of operation, the controller 21 will no longer be input the "go" signal and so, in response, cause the valve 18 to place the head end chamber of the air cylinder 12 in communication with the compressed air source 19 and cause the servomotor 17 to rotate in a reverse direction. The air cylinder 12 will then extend, resulting in the retraction of the tension roller 8. The turnbar 4*a* will also retract upon reverse rotation of the servomotor 17. It is suggested that the nip rollers 7 be held against the tension rollers 6*a* and 6*b*, nipping the web 2 against these rollers, even after the web has stopped running.

Slackened as above between the tension rollers 6*a* and 6*b* during the nonoperation of the machine, the web 2 will develop no semipermanent curls by being held against the tension roller 8 and turnbars 4*a* and 4*b*. However, the web is held nipped by the nip rollers 7 against the tension rollers 6*a* and 6*b* even when the machine is out of operation. There will therefore be no longitudinal web displacement between these tension rollers 6*a* and 6*b* even if it is tensioned and slackened when the machine goes into and out of operation.

It is understood that the manual switch 23 can override the foregoing automatic operation. The tension roller 8 and turnbar 4*a* may be actuated to and away from their working positions whenever required by this manual switch.

Figure 6:
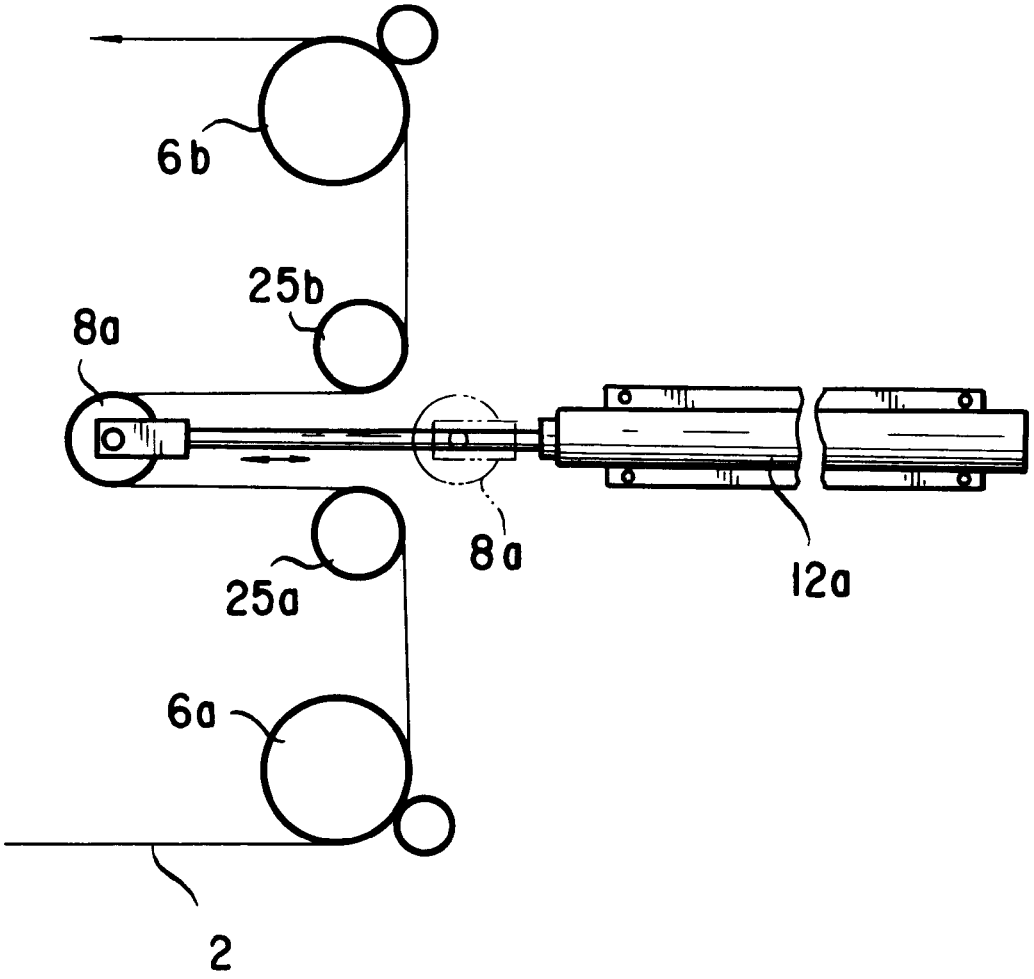
FIG. 6 is a diagram showing another embodiment of the invention.
Figure 7:
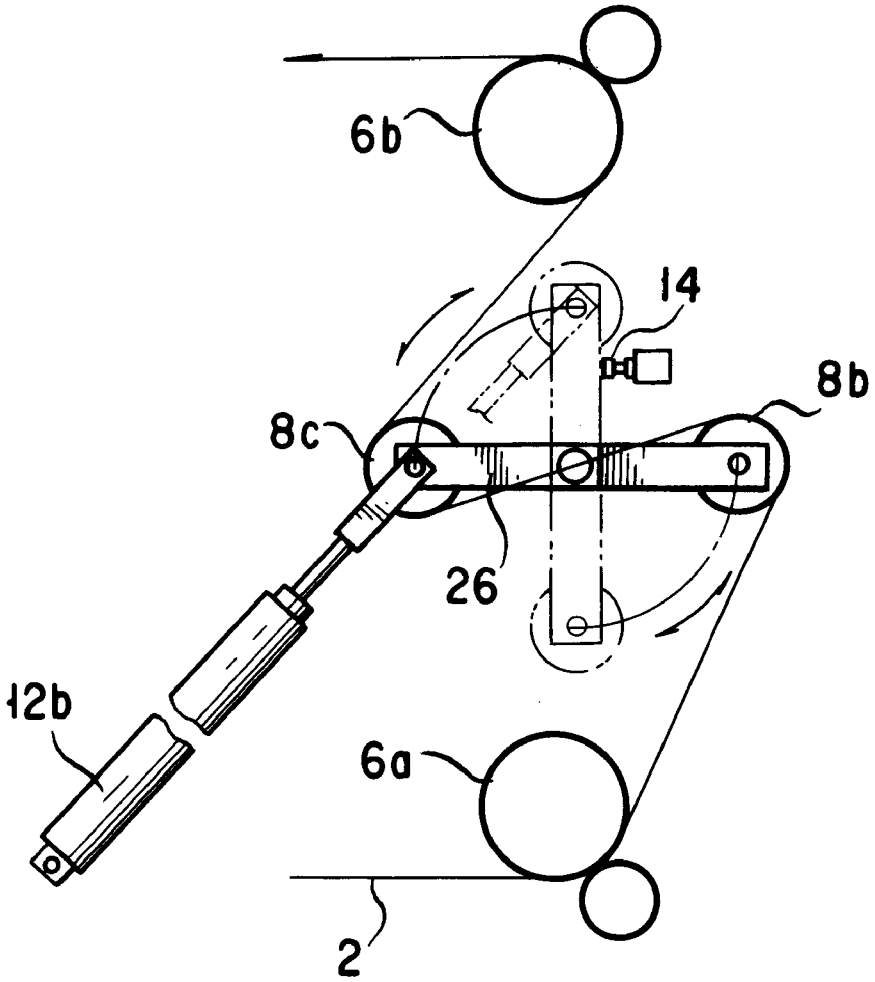
FIG. 7 is a diagram showing still another embodiment of the invention.

Even though the foregoing embodiment reflects an exemplary application of the invention, it should not be taken in a limitative sense since the present invention may be embodied in various other forms. FIGS. 6 and 7 show such additional embodiments.

In FIG. 6 are shown two guide rollers 25*a* and 25*b* in parallel spaced relationship to each other between the tension rollers 6*a* and 6*b*. To be retracted according to the concepts of this invention, a tension roller 8*a* extends across the path of the web defined by these tension rollers 6*a* and 6*b* and guide rollers 25*a* and 25*b*. A linear actuator 12*a* such as a fluid actuated cylinder is rotatably coupled to the tension roller 8*a* for moving the same between the solid-line working position and the phantom retracted position in a direction normal to the axis of rotation of the tension roller.

FIG. 7 illustrates the invention as adapted for jointly moving two tension rollers 8*b* and 8*c* extending across, and opposite sides of, the web 2. These tension rollers are rotatably supported at the opposite ends of a pair of carrier arms 26 which are medially pivoted for joint angular displacement about a fixed axis parallel to the axes of rotation of the tension rollers 8*b* and 8*c*. A linear actuator 12*b* such as a fluid actuated cylinder is operatively coupled to the carrier arms 26 for bidirectionally driving the same about its medial pivot and hence for causing the two tension rollers 8*b* and 8*c* to travel jointly between the solid-line working positions and the phantom retracted positions.

Various other modifications and alterations of the representative embodiment will suggest themselves to one skilled in the art. Further the invention may be applied to the other processing stations, including the printing station, of a streamlined rotary printing press, as well as to other web-handling machines where the web will develop semipermanent curls if left standing still for an extended length of time. It is therefore appropriate that the invention be construed broadly and in a manner consistent with the fair meaning or proper scope of the claims which follow.

What is claimed is:

1. A web-handling machine for guiding a continuous web of paper or like material along a predefined path, comprising:

(a) a tension member;

(b) a drive mechanism for moving said tension member between a working position, in which said tension member is held contiguous to the predefined path of the web for holding the web under tension, and a retracted position, in which said tension member is held away from the predefined path of the web for relieving the web of tension; and (c) a control mechanism connected to said drive mechanism and adapted to operate said drive mechanism so as to automatically move said tension member to the working position in response to an operation signal received by said control mechanism when the web-handling machine is operating, and adapted to operate said drive mechanism so as automatically move said tension member to the retracted position in response to a non-operation signal received by said control mechanism when the web-handling machine is not operating; whereby the web can be prevented from curling due to being held still and under tension against the tension member during the non-operation of the web-handling machine.

2. The invention of claim 1, wherein said tension member is a tension roller extending across the predefined path of the web, and wherein said drive means comprises:

(a) a crankshaft rotatable about a fixed axis parallel to an axis of rotation of said tension roller;

(b) a pair of crank webs proximally mounted fast to said crankshaft for joint angular displacement therewith and distally rotatably carrying said tension roller; and (c) an actuator operatively coupled to said crankshaft for bidirectionally rotating said crankshaft so as to cause angular displacement of said pair of crank webs and consequent travel of said tension roller between the working position and the retracted position.

3. The invention of claim 1, wherein said tension member is a tension roller extending across the predefined path of the web, and wherein said drive mechanism comprises a linear actuator rotatably coupled to said tension roller for moving said tension roller between the working position and the retracted position in a direction normal to an axis of rotation of said tension roller.

4. The invention of claim 1, wherein said tension member is a first tension roller extending across the predefined path of the web on a first side of the web, and wherein said drive means comprises:

(a) a pair of carrier arms medially pivoted for joint angular displacement about a fixed axis parallel to an axis of rotation of said tension roller and rotatably carrying said tension roller between one pair of ends thereof and a second tension roller between another pair of ends thereof, said second tension roller being disposed on a second side of the web; and (b) an actuator operatively coupled to said pair of carrier arms for bidirectionally rotating said pair of carrier arms so as to cause said first tension roller and said second tension roller to move jointly between the working position and the retracted position.

5. A web-handling machine for guiding a continuous web of paper or like material along a predefined path, comprising:

(a) a tension member; and (b) a drive mechanism for moving said tension member between a working position, in which said tension member is held contiguous to the predefined path of the web for holding the web under tension, and a retracted position, in which said tension member is held away from the predefined path of the web for relieving the web of tension;

wherein the web can be prevented from curling due to being held still and under tension against the tension member during the non-operation of the web-handling machine, and wherein said tension member is a turnbar extending at an angle to the transverse direction of the web traveling along the predefined path in order to cause an angular change in the traveling direction of the web, and wherein said drive mechanism comprises:

(a) a pair of lead screws rotatably supported by a frame, said pair of lead screws extending in parallel spaced relationship to each other and transversely to the traveling direction of the web before the traveling direction of the web is changed the turnbar;

(b) a pair of nuts fitted one over each of said pair of lead screws and coupled to opposite ends of said turnbar; and (c) an actuator operatively coupled to said pair of lead screws for bidirectionally rotating the pair of lead screws relative to said nuts such that said turnbar travels linearly with said nuts between the working position and the retracted position.

6. A web-fed rotary printing press, comprising:

(a) two sets of nip rollers for holding a continuous web of paper or like material under tension as the web travels in a prescribed direction along a predefined path;

(b) a tension roller disposed between said two sets of nip rollers for imparting tension to the web;

(c) a first drive mechanism for moving said tension roller between a working position, in which said tension roller is held contiguous to the predefined path of the web for holding the web under tension as when the press is in operation, and a retracted position in which said tension roller is held away from the predefined path of the web for relieving the web of tension as when the press is out of operation;

(d) a slitter disposed between said two sets of nip rollers and downstream of said tension roller with respect to the prescribed traveling direction of the web for longitudinally slitting the web down the middle thereof into a pair of halves;

(e) a superposing mechanism disposed between said two sets of nip rollers and downstream of said slitter with respect to the prescribed traveling direction of the web for placing the pair of web halves one upon the other, said superposing mechanism including a turnbar extending at an angle to the transverse direction of a first web half in order to cause an angular change in the traveling direction thereof;

(f) a second drive mechanism for moving said turnbar of said superposing mechanism between a working position, in which said turnbar is held against the first web half for holding the first web half under tension as when the press is in operation, and a retracted position in which said turnbar is held away from the predefined path of the first web half for relieving the first web half of tension as when the press is out of operation; and (g) a control mechanism connected to said first drive mechanism and said second drive mechanism for automatically causing said first drive mechanism and said second drive mechanism to move said tension roller and said turnbar to the working positions thereof as when the press is set into operation, and to the retracted positions thereof as when the press is set out of operation;

(h) whereby the web can be prevented from curling due to being held still and under tension against said tension roller and said turnbar during the non-operation of the machine, without the risk of longitudinal web displacement relative to said tension roller and said turnbar as the web is held nipped by said two sets of nip rollers during the retraction of said tension roller and said turnbar.

7. The invention of claim 6, wherein said control mechanism has an input connected to a "ready" switch which is to be actuated preparatory to an actual start of operation of the printing press, said control mechanism being responsive to actuation of the "ready" switch for causing said tension roller and said turnbar to be moved to the working positions thereof.

8. The invention of claim 7, wherein said control mechanism has another input connected to a manual switch capable of overriding the "ready" switch.

* * * * *